US007967125B2

(12) United States Patent
Ishimatsu et al.

(10) Patent No.: US 7,967,125 B2
(45) Date of Patent: Jun. 28, 2011

(54) DEFORMED-COIN DETECTOR

(75) Inventors: Takashi Ishimatsu, Himeji (JP); Satoru Katori, Himeji (JP); Kazuyuki Shimizu, Himeji (JP); Yasushi Hiraoka, Himeji (JP); Osamu Uehara, Himeji (JP)

(73) Assignee: Glory Ltd., Himeji-shi, Hyogo (JP)

( * ) Notice: Subject to any disclaimer, the term of this patent is extended or adjusted under 35 U.S.C. 154(b) by 210 days.

(21) Appl. No.: 12/305,284

(22) PCT Filed: Jul. 21, 2006

(86) PCT No.: PCT/JP2006/314483

§ 371 (c)(1),
(2), (4) Date: Dec. 17, 2008

(87) PCT Pub. No.: WO2008/010295

PCT Pub. Date: Jan. 24, 2008

(65) Prior Publication Data

US 2010/0230234 A1 Sep. 16, 2010

(51) Int. Cl.
*G07D 5/02* (2006.01)

(52) U.S. Cl. ..... 194/328; 73/163

(58) Field of Classification Search ..... 194/328, 194/335, 337, 340, 341; 73/163; 209/615, 209/616, 617, 658, 663
See application file for complete search history.

(56) References Cited

U.S. PATENT DOCUMENTS 3,191,739 A * 6/1965 White Jr. ..... 194/333

FOREIGN PATENT DOCUMENTS

| | | | |
|---|---|---|---|
| JP | 59-36887 | A | 2/1984 |
| JP | 63-210611 | A | 9/1988 |
| JP | 09-161118 | A | 6/1997 |
| JP | 2006-40099 | A | 2/2006 |

* cited by examiner

*Primary Examiner* — Jeffrey A Shapiro
*Assistant Examiner* — Mark J Beauchaine
(74) *Attorney, Agent, or Firm* — Renner, Kenner, Greive, Bobak, Taylor & Weber

(57) ABSTRACT

A deformed-coin detector accurately detecting a deformed coin without being affected by a variation in transporting speed of a coin. A coin transported along a coin transporting face comes into contact with detecting elements of coin-thickness detecting bodies, the detecting elements move by a distance corresponding to the dimension of the coin in its thickness direction and simultaneously, light shielding portions of the coin-thickness detecting bodies move. A light detecting portion detects a light shielding amount that varies due to movement of the light shielding portions. A coin denomination determining unit determines a denomination of the coin transported along the coin transporting face and reads a reference light-shielding amount pre-stored in a reference light shielding amount storing unit regarding the denomination. The light shielding amount detected by the light detecting portion is compared with the reference light shielding amount, and when the detected light shielding amount is out of a predetermined range with respect to the reference light shielding amount, the coin is judged to be a deformed coin.

4 Claims, 6 Drawing Sheets

DEFORMED-COIN DETECTOR

CROSS REFERENCE TO RELATED APPLICATIONS

This is a U.S. national phase application under 35 U.S.C. §371 of International Patent Application No. PCT/JP2006/314483, filed Jul. 21, 2006. The International Application was published on Jan. 24, 2008 as International Publication No. WO 2008/010295 under PCT Article 21(2) the contents of which are incorporated herein in their entirety.

TECHNICAL FIELD

The present invention relates to a deformed-coin detector capable of accurately detecting a deformed coin.

BACKGROUND

In a conventional coin processing machine, for example, a plurality of coins collectively put into a coin input port are transported one by one along a coin passage, the authenticity and denomination of each of the coins transported along the coin passage are identified by an identifying portion, and the coins are forwarded to a post-processing portion, in which a sorting mechanism for sorting coins for each denomination in accordance with a result of identification is disposed, to be processed.

In the case where a deformed coin having a deformed shape is included in the coins put into the coin processing machine, since the identifying portion cannot identify the deformed coin, the deformed coin identified as a normal coin is forwarded to the post-processing portion as it is. Thus, there is a possibility that, in the post-processing portion, the deformed coin causes a coin jam or a problem such as mechanical damage.

Thereupon, a deformed-coin detector for detecting a deformed coin transported along a coin passage has been developed. The deformed-coin detector includes a transporting unit for straightly transporting coins in the coin passage at a fixed speed and a line sensor which is arranged along a width direction orthogonal to a coin transporting direction of the coins in the coin passage. In the line sensor, a number of detecting elements capable of detecting a coin are linearly arranged along the width direction of the coin passage and arranged opposite to a surface of the coin transported in the coin passage.

The deformed-coin detector detects the width of a coin in the transporting direction, based on a detection time from start to end of detection of any one, which first detects the coin transported by the transporting unit, of the detecting elements of the line sensor, and a transporting speed of the transporting unit. Additionally, the detector detects the width of the coin in a direction orthogonal to the transporting direction of the coin, based on the distance between the detecting elements, which detect the coin and are farthest from each other among a number of detecting elements of the line sensor. Based on a difference between the width in the transporting direction and the width in the direction orthogonal thereto, it is determined whether the coin is a deformed coin (see, for example, Japanese Laid-Open Patent Publication No. 9-161118 (pages 4-5, FIGS. 1 to 4).

SUMMARY OF THE INVENTION

However, in a conventional deformed-coin detector, detection accuracy lowers in the case where, although a transporting speed of a coin is required to be fixed for precisely detecting the width of the coin in a transporting direction, it is varied due to load variation or the like.

The present invention was made in view of such a problem, and an object thereof is to provide a deformed-coin detector capable of accurately detecting a deformed coin without being affected by a variation in transporting speed of the coin.

A deformed-coin detector includes: a coin-thickness detecting body having a detecting element which is arranged facing a coin transporting face, comes into contact with a coin transported along the coin transporting face when the coin passes therethrough, and moves by a distance corresponding to the dimension of the coin in its thickness direction, and a light shielding portion moving in conjunction with movement of the detecting element; an elastic member for elastically biasing the detecting element of the coin-thickness detecting body to the coin transporting face side; a light detecting portion which has a light source and a light receiving portion, which are arranged across the light shielding portion of the coin-thickness detecting body from each other, and detects a light shielding amount varied in accordance with movement of the light shielding portion of the coin-thickness detecting body; a coin denomination determining unit for determining a denomination of the coin transported along the coin transporting face; a reference light shielding amount storing unit for, for each denomination, pre-storing a reference light shielding amount that is detected by the light detecting portion when a non-deformed coin passes through the position of the detecting element of the coin-thickness detecting body; and a control portion for, when the coin is transported along the coin transporting face, comparing the light shielding amount detected by the light detecting portion with the reference light shielding amount pre-stored in the reference light shielding amount storing unit regarding the denomination determined by the coin denomination determining unit, and judging that the coin transported along the coin transporting face is a deformed coin in the case where the detected light shielding amount is out of a predetermined range with respect to the reference light shielding amount.

The coin transported along the coin transporting face comes into contact with the detecting element of the coin-thickness detecting body, and thus, the detecting element moves by the distance corresponding to the dimension of the coin in its thickness direction and simultaneously, the light shielding portion of the coin-thickness detecting body moves, and the light shielding amount detected by the light detecting portion varies in accordance with the movement of the light shielding portion. The light shielding amount detected by the light detecting portion is compared with the reference light shielding amount pre-stored in the reference light shielding amount storing unit regarding the denomination, which is determined by the coin denomination determining unit, of the coin transported along the coin transporting face, and the coin transported along the coin transporting face is judged to be a deformed coin in the case where the detected light shielding amount is out of the predetermined range with respect to the reference light shielding amount.

The detecting element is provided at one end of the coin-thickness detecting body, the light shielding portion is provided at the other end thereof, and the detecting element and the light shielding portion are provided rotatably around a support shaft so as to rock The light shielding portion moves by a distance corresponding to the dimension of the coin in its thickness direction by rotation of the coin-thickness detecting body around the support shaft, and the light detecting portion can detect the precise light shielding amount.

The detecting element of the coin-thickness detecting body is cylindrically provided corresponding to a transporting direction of the coin transporting face, and provided rotatably in its circumferential direction.

The detecting element of the coin-thickness detecting body smoothly comes into contact with the coin, and wear of the detecting element is reduced.

A plurality of the coin-thickness detecting bodies are provided and independently movably arranged at a plurality of positions of the coin transporting face in its width direction, in the deformed-coin detector according to any of claims 1 to 3.

The light shielding amount to be detected by the light detecting portion is decided by any one of the light shielding portions of the plurality of coin-thickness detecting bodies, and the size and deformation location or the like of the coin can be handled.

DETAILED DESCRIPTION OF THE INVENTION

Figure 6:
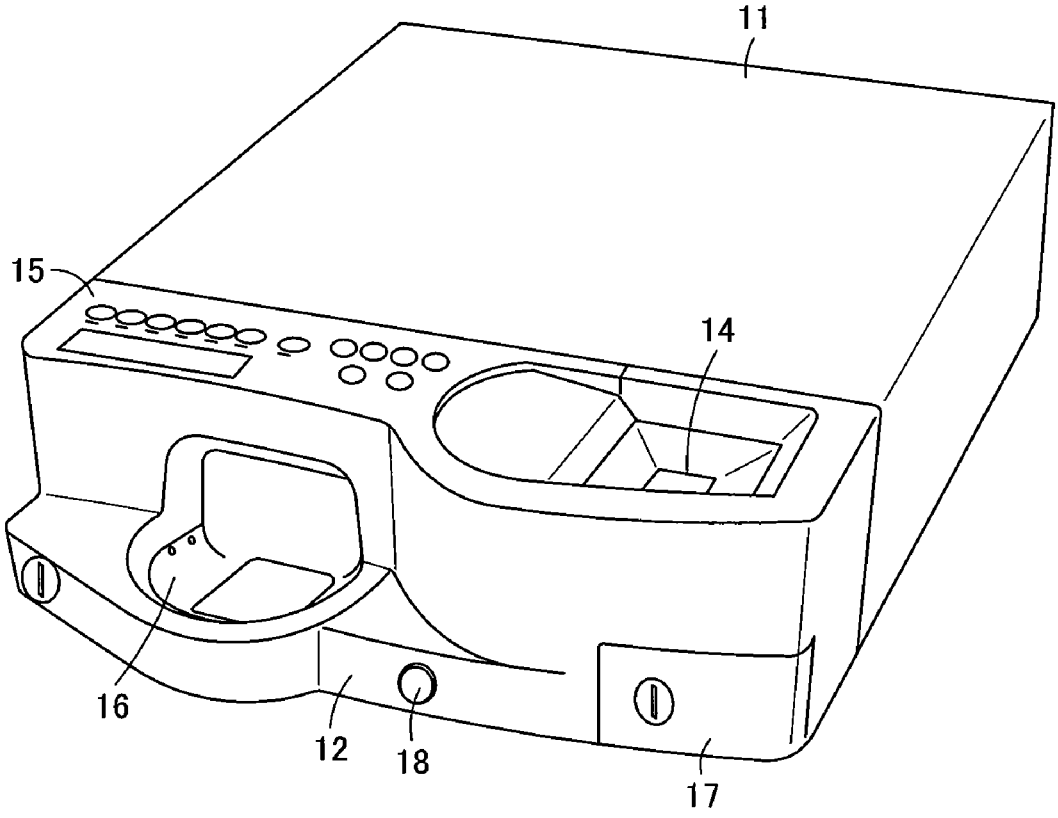
FIG. 6 is a perspective view of an automatic change dispenser to which the deformed-coin detector is applied.
Figure 7:
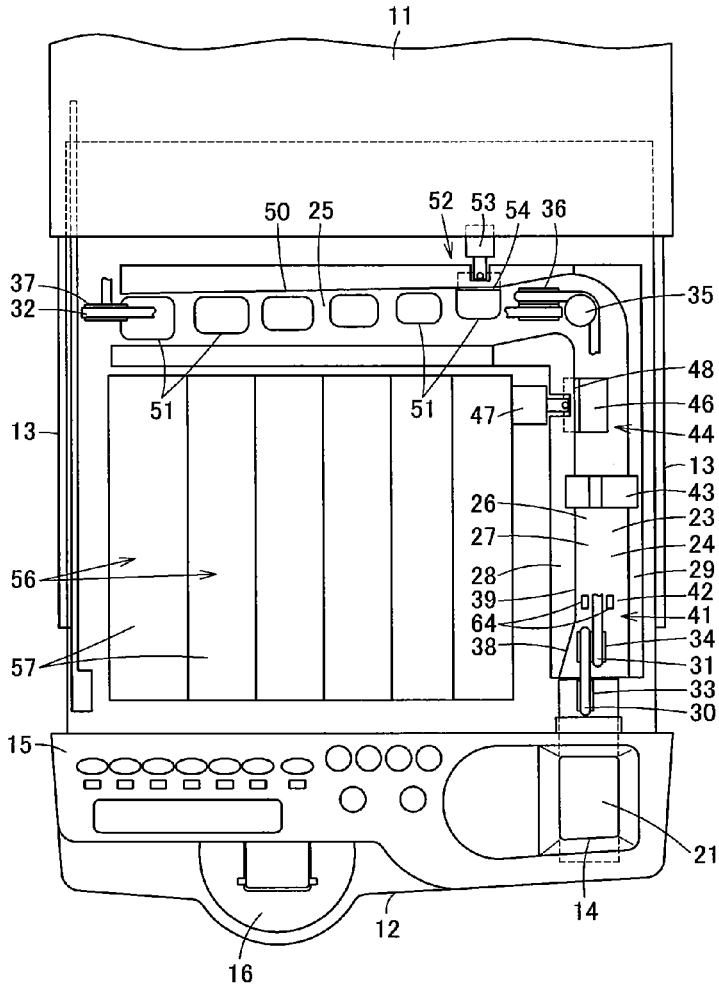
FIG. 7 is a plan view showing an inner structure of the automatic change dispenser.
Figure 8:
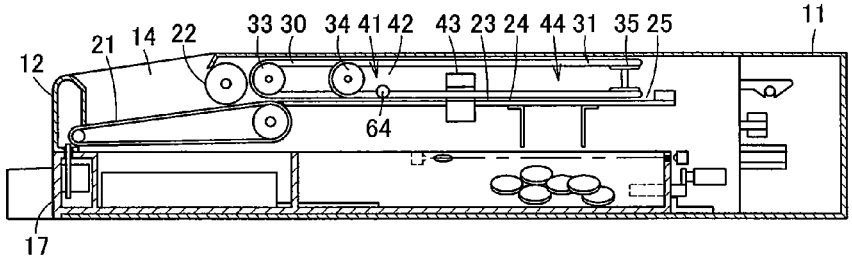
FIG. 8 is a cross sectional view of the automatic change dispenser.

FIGS. 6 to 8 show an automatic change dispenser as an example of a coin processing machine to which a deformed-coin detector is applied.

The automatic change dispenser is set up at a cash counter of a store such as a supermarket or a fast-food shop. Coins received from a customer are accepted and accommodated for each denomination, and automatically dispensed as change in accordance with a change dispensing command transmitted from a cash register or the like.

The reference numeral 11 denotes a frame body, and a dispenser body 12 is attached into the frame body 11 through a front opening of the frame body 11, and supported by both-side guide rail mechanisms 13, which are disposed on inner faces of both sides of the frame body 11, so as to be pulled out from the frame body 11.

In the front of the dispenser body 12, in the upper front position, a coin input port 14 is formed on the right side of the top face and an operating portion 15 is formed on the left side of the top face, and further, in the lower front position, a coin dispensing port 16 is formed on the left side, a return box 17 is disposed on the right side so as to be attachable/detachable, that is, pulled forward, and a power switch 18 is disposed at the center.

Additionally, a flat belt 21 constituting the bottom of the coin input port 14 is longitudinally disposed under the coin input port 14. Coins on the flat belt 21 are fed and transported rearward by rotation of the flat belt 21. A reverse rotating roller 22 is disposed above the rear end side of the flat belt 21, the roller rotating reversely in a rotating direction of an upper face of the flat belt 21 and regulating the coins on the flat belt 21 so that the coins pass one by one in its thickness direction.

The rear end of the flat belt 21 is connected to an entrance of a coin passage 23. The coin passage 23 has a first passage portion 24 disposed along the right side of the dispenser body 12 and a second passage portion 25 disposed along the rear side of the dispenser body 12, and is formed in an approximate L-shape as a whole. The coin passage 23 is formed on a passage plate 27 constituting a coin transporting face 26 and between both side plates 28, 29 constituting both sides of a passage.

Transporting belts 30, 31 and 32 are disposed, above the coin passage 23, as a transporting unit for transporting coins while pressing them against the coin transporting face 26. The transporting belts 30, 31 and 32 are stretched by pulleys 33, 34, 35, 36 and 37. A coin transporting speed of the transporting belts 30, 31 and 32 is higher than a coin feeding speed of the flat belt 21, and coins fed into the coin passage 23 are transported one by one at intervals in front and behind.

Additionally, a tilt portion 38 projecting toward the center of the passage is formed at an entrance of the first passage portion 24 in the side plate 28 on one side of the first passage portion 24, and a reference edge 39 is formed continuously to the tilt portion 38. Coins fed into the first passage portion 24 come into contact with the tilt portion 38 and are transported while coming into contact with the reference edge 39.

In the first passage potion 24, with the reference edge 39 of the side plate 28 on one side as a reference, a deformed-coin detecting portion 42, coin denomination determining unit 43 and coin diverting portion 44 of a deformed-coin detector 41 are disposed in this order from the upstream side in a coin transporting direction. The deformed-coin detecting portion 42 of the deformed-coin detector 41 will be described below.

The coin denomination determining unit 43 determines normal/abnormal and denomination of the coin from the material quality, diameter, presence/absence of a hole. Although various denomination determining methods are known, the denomination can be simply determined by detecting the diameter. As a more accurate method, the technology disclosed in, for example, Japanese Laid-Open Patent Publication No. 2003-256902, can be used.

When a deformed coin is detected by the deformed-coin detector 41 or a certain coin is determined to be an abnormal coin by the coin denomination determining unit 43, the coin diverting portion 44 forcibly drops and diverts the coin. A diversion hole 46 is formed in the passage plate 27, and a shutter 48 is arranged in the diversion hole 46, the shutter 48 being moved into/out of the passage in a passage width direction by a solenoid 47. In the coin diverting portion 44, a normal coin is normally allowed to pass with the shutter 48 entering the passage, and in the case where the deformed coin is detected or a certain coin is determined to be the abnormal coin, the shutter 48 is moved out of the passage, and the deformed coin and abnormal coin are dropped from the diversion hole 46 and accommodated into the return box 17 located below the hole.

Additionally, in the second passage portion 25, a reference edge 50 projecting toward the center of the passage is formed in the side plate 29 on the other side. Sorting holes 51 are formed along the reference edge 50, the sorting holes 51 for sorting coins for each denomination based on their diameters in the order from a coin having a smaller diameter at the upstream side to a coin having a larger diameter at the downstream side.

A coin sorting portion 52 for forcibly sorting coins is provided as one of the sorting holes 51 and is located at the most upstream side thereof. In the coin sorting portion 52, a shutter 54 is arranged in the sorting hole 51, the shutter 54 being moved into/out of the passage in the passage width direction by a solenoid 53. In the coin sorting portion 52, when a coin determined as having a denomination to be sorted by the coin denomination determining unit 43 reaches the coin sorting portion 52, the shutter 54 is moved out of the passage and the coin of the denomination to be sorted is dropped from the sorting hole 51. Additionally, coins of denominations other than the denomination to be sorted are made to pass with the shutter 54 entering the passage, and sorted based on their diameters at the denomination-specific sorting holes 51 at the downstream side.

Additionally, the coins dropped from the sorting holes 51 of the second passage portion 25 are, by denomination, distinguished and accommodated in denomination-specific accommodating portions 56 located under the holes. The denomination-specific accommodating portions 56 are divisionally formed for each denomination in a right and left direction of the dispenser body 12, and each has a bottom constituted by a flat belt 57. A reverse rotating roller (not shown) for rotating reversely in the rotating direction of an upper face of the flat belt 57 is disposed on the front end side of the flat belt 57. Coins on the rotating flat belt 57 are regulated to one layer in its thickness direction by the reverse rotating roller, and ejected forward one by one from the denomination-specific accommodating portion 56 by the rotation of the flat belt 57. The coins ejected forward from each denomination-specific accommodating portion 56 are dispensed into the coin dispensing port 16.

Next, the deformed-coin detector 41 will be described with reference to FIGS. 1 to 5.

The deformed-coin detecting portion 42 of the deformed-coin detector 41 has a pair of coin-thickness detecting bodies 60, and the coin-thickness detecting bodies 60 face the upper side of the coin transporting face 26 and juxtaposed across the transporting belt 31 from each other in the passage width direction.

Figure 3:
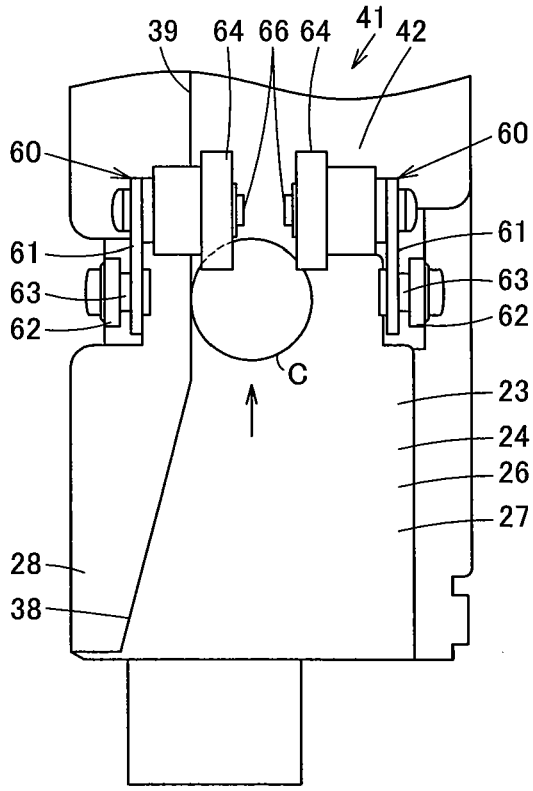
FIG. 3 is a plan view of the deformed-coin detector.
Figure 4:
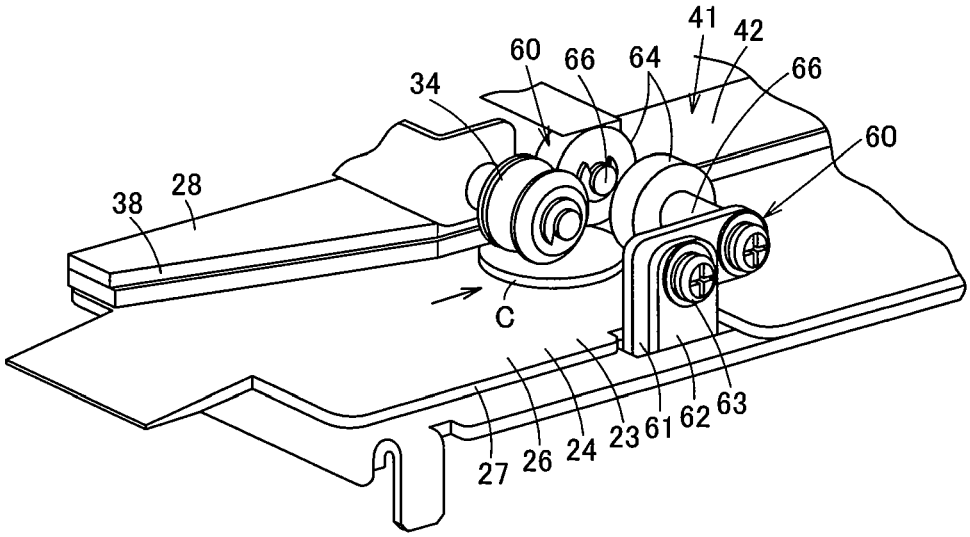
FIG. 4 is a perspective view of the deformed-coin detector.

The coin-thickness detecting bodies 60 each has a lever 61, and the intermediate portion of the lever 61 is rotatably supported by a support shaft 63 with respect to each of supporting portions 62 projected from both sides of the coin transporting face 26, the support shaft 63 extending across the coin transporting direction and being horizontal. A detecting element 64 is provided at one end at the downstream side of the coin-thickness detecting body 60 in the coin transporting direction, and a light shielding portion 65 is provided at the other end at the upstream side of the coin-thickness detecting body 60 in the coin transporting direction. Moreover, the lever 61 of the coin-thickness detecting body 60 is linearly shown in schematic views of FIGS. 1 and 2, however, as shown in FIGS. 3 and 4, specifically the other end of the coin-thickness detecting body 60 is arranged lower than the passage plate 27, and the lever 61 of the coin-thickness detecting body 60 is formed in an approximate S-shape. Additionally, the pair of coin-thickness detecting bodies 60 independently operate.

As the detecting element 64 of the coin-thickness detecting body 60, for example, a cylindrical roller bearing is used corresponding to the coin transporting direction, and the detecting element 64 is provided so as to be rotatable in its circumferential direction by a rotary shaft 66.

Each of the coin-thickness detecting bodies 60 is elastically biased in a direction that the detecting elements 64 approach the coin transporting face 26, by an elastic member 67 such as an extension spring stretched between the lever 61 and the passage plate 27. Rocking of the coin-thickness detecting bodies 60 in the direction that the detecting elements 64 approach the coin transporting face 26 is regulated by a stopper (not shown) in the case of no coin (the reference symbol C is attached to a coin in FIGS. 1, 3 and 4, but the symbol will be omitted hereinafter), and the distance between the detecting element 64 and the coin transporting face 26 is set to the thickness of, for example, a 10 cent coin which is the thinnest of the U.S. denominations, 1.30 mm, or less. Moreover, the thicknesses of coins of U.S. denominations, 1 cent, 25 cents, 5 cents, 1 dollar and 10 cents, are 1.65 mm, 1.75 mm, 2.05 mm, 2.00 mm and 1.30 mm, respectively.

A light source 70 and light receiving portion 71 of a light detecting portion 69 are arranged across light shielding portions 65 of the pair of coin-thickness detecting bodies 60 from each other. The light detecting portion 69 detects the amount of light which the light receiving portion 71 receives from the light source 70, specifically, detects the amount of light, which is to be received by the light receiving portion 71 from the light source 70 but is shielded by the light shielding portions 65, in accordance with the movement positions of the light shielding portions 65 of the coin-thickness detecting bodies 60.

When a coin passes through the position of the coin-thickness detecting bodies 60, the detecting elements 64 come into contact with the coin and move upward by a distance corresponding to the dimension of the coin in its thickness direction, the light shielding portions 65 move downward in conjunction with movement of the detecting elements 64, and the light detecting portion 69 detects the amount of the light shielded by the light shielding portions 65.

Figure 5:
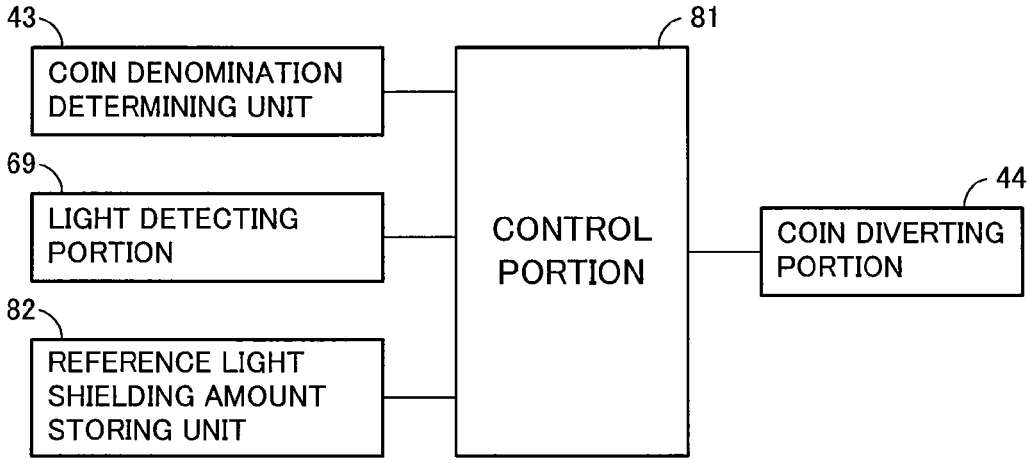
FIG. 5 is a block diagram of the deformed-coin detector.

Additionally, FIG. 5 shows a control portion 81 of the deformed-coin detector 41, and the control portion 81 inputs information from the coin denomination determining unit 43, light detecting portion 69 and a reference light shielding amount storing unit 82 to control the coin diverting portion 44.

The reference light shielding amount storing unit 82 pre-stores, for each denomination, a reference light shielding amount that is detected by the light detecting portion 69 when a non-deformed coin passes through the position of the detecting elements 64 of the coin-thickness detecting bodies 60.

The control portion 81 compares, when the coin is transported along the coin transporting face 26, the light shielding amount detected by the light detecting portion 69 with the reference light shielding amount pre-stored in the reference light shielding amount storing unit 82 regarding the denomination determined by the coin denomination determining unit 43, and judges, in the case where the detected light shielding amount is out of a predetermined range with respect to the reference light shielding amount, that the coin transported along the coin transporting face 26 is a deformed coin.

Next, operation of the present embodiment will be described.

The automatic change dispenser is placed on a register counter, a cash register is placed on the automatic change dispenser, and the automatic change dispenser is used in this state.

A depositing function of the automatic change dispenser will be described.

Coins received by a cashier from a customer are put into the coin input port 14, and thus, a depositing process is automatically started.

When the depositing process is started, the coins put into the coin input port 14 are fed to the first passage portion 24 of the coin passage 23 one by one by the flat belt 21 and the reverse rotating roller 22. While the coins fed to the first passage portion 24 are transported by the transporting belts 30, 31, presence/absence of deformation is detected by the deformed-coin detecting portion 42, and the authenticity and denomination are determined by the coin denomination determining unit 43. If consequently, the coin is a normal coin and is not a deformed coin, it is made to pass through the coin diverting portion 44, fed to the second passage portion 25, sorted for each denomination, and accommodated by denomination in the denomination-specific accommodating portion 56.

When the abnormal coin or deformed coin is detected, it is diverted by the coin diverting portion 44, accommodated in the return box 17 and can be returned.

If the coin denomination determining unit 43 detects no coin for a predetermined time or more, the depositing process is stopped.

Next, a dispensing function of the automatic change dispenser will be described.

When a change dispensing signal is input from the cash register to the dispenser, a dispensing process is started.

When the dispensing process is started, the coins in the denomination-specific accommodating portion 56 are fed forward one by one by rotations of the flat belt 57 of the denomination-specific accommodating portion 56 and a reverse rotating roller (not shown). At this time, feeding of the coins in the denomination-specific accommodating portions 56 of denominations of coins not to be dispensed is regulated by stoppers (not shown), and the coins are allowed to be fed, by the number of coins required, from only the denomination-specific accommodating portion 56 of a denomination of coins to be dispensed. When the entire dispensing according to the change dispensing signal is completed, the dispensing process is stopped.

The coins fed from the denomination-specific accommodating portion 56 are dispensed into the coin dispensing port 16, and the coins dispensed into the coin dispensing port 16 are taken out by the cashier and delivered to the customer as change.

Next, deformed-coin detecting operation of the deformed-coin detector 41 will be described.

Figure 1:
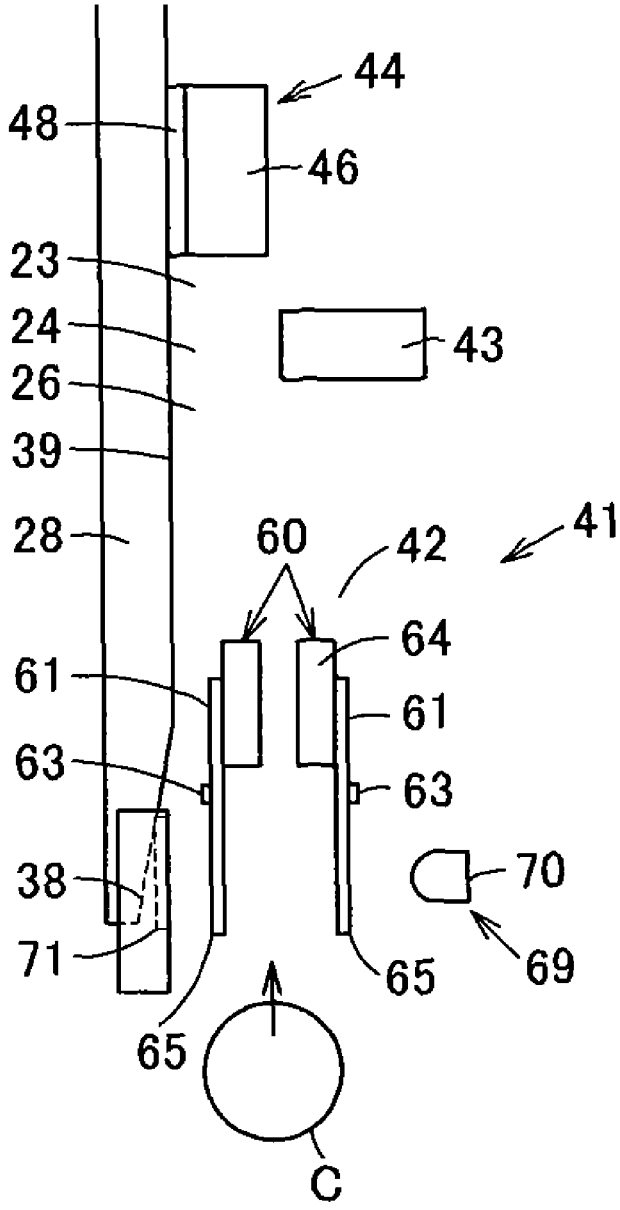
FIG. 1 is a schematic view of a deformed-coin detector of an embodiment of the present invention.
Figure 2:
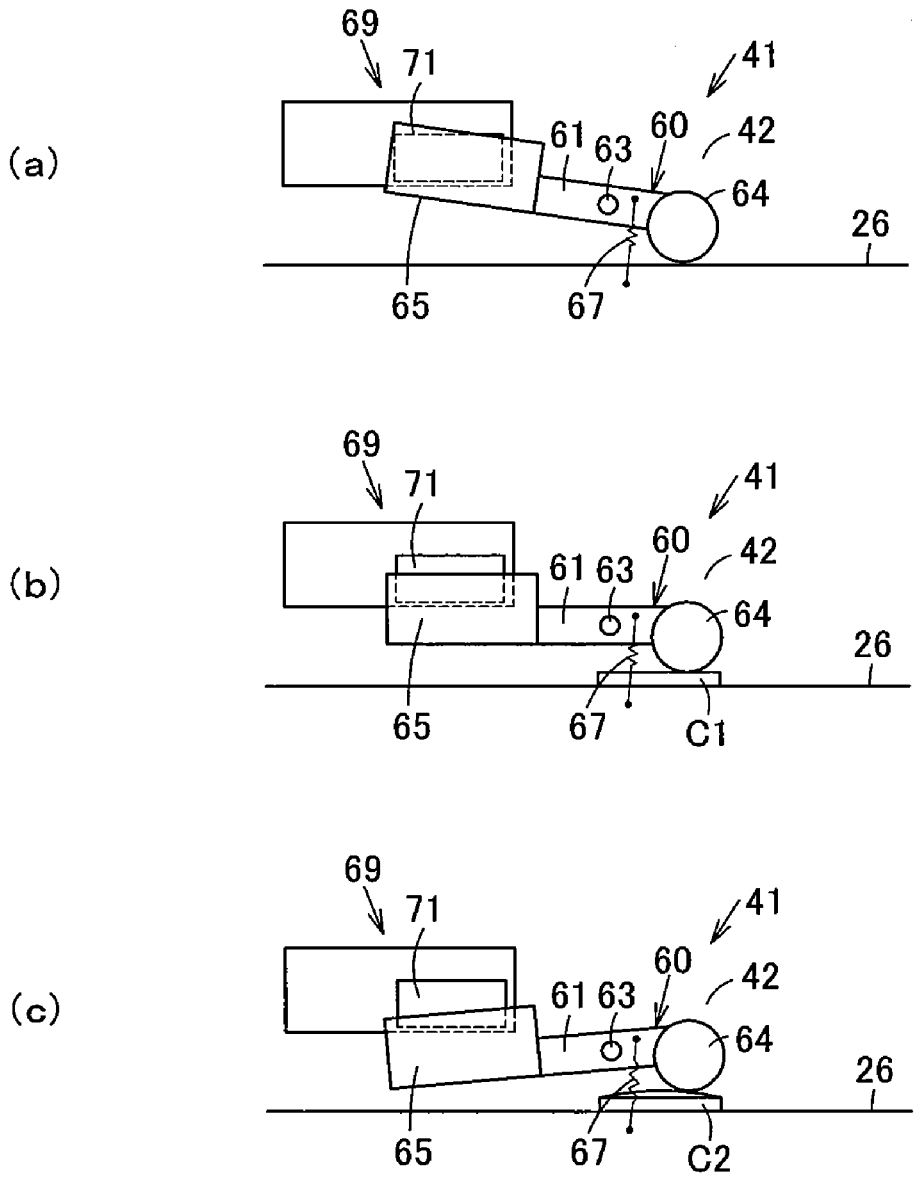
FIG. 2 shows a deformed-coin detecting operation of the deformed-coin detector, and FIG. 2(*a*) is a schematic view in the case of no coin, FIG. 2(*b*) is a schematic view in the case of a non-deformed coin, and FIG. 2(*c*) is a schematic view in the case of a deformed coin.

As shown in FIG. 2(*a*), in the case where there is no coin under the detecting elements 64 of the coin-thickness detecting bodies 60, the distance between the detecting elements 64 and the coin transporting face 26 is kept, for example, 1.30 mm that is a thickness of the thinnest U.S. coin, 10 cent coin, or less. In this state, the light shielding portions 65 of the coin-thickness detecting bodies 60 has moved upward, the amount of the light, which is to be received by the light receiving portion 71 from the light source 70 but is shielded by the light shielding portions 65, is maximum.

As shown in FIG. 2(*b*), in the case where a non-deformed coin C1 having no deformation passes under the detecting elements 64 of the coin-thickness detecting bodies 60, the detecting elements 64 are pushed up by the coin C1 against biasing force of the elastic members 67. The detecting elements 64 move upward by a distance corresponding to the dimension of the non-deformed coin C1 in its thickness direction. Thus, the coin-thickness detecting bodies 60 rock around the support shafts 63 by the upward movement of the detecting elements 64, and the light shielding portions 65 move downward. Due to the downward movement of the light shielding portions 65, the amount of the light, which is to be received by the light receiving portion 71 from the light source 70 but is shielded by the light detecting portion 69, is reduced, and the light shielding amount is detected by the light detecting portion 69.

The non-deformed coin Cl, which has passed under the detecting elements 64 of the coin-thickness detecting bodies 60, is transported to the coin denomination determining unit 43 at the downstream side, and a denomination of the coin C1 is determined by the coin denomination determining means 43.

The control portion 81 reads the reference light shielding amount pre-stored in the reference light shielding amount storing unit 82 regarding the denomination determined by the coin denomination determining means 43, compares the light shielding amount detected by the light detecting portion 69 with the reference light shielding amount, and judges whether the detected light shielding amount is out of the predetermined range with respect to the reference light shielding amount.

Here, since the non-deformed coin C1 is transported, the detected light shielding amount is within the predetermined range with respect to the reference light shielding amount, and the coin C1 is not detected as a deformed coin. Therefore, the non-deformed coin C1 passes through the coin diverting portion 44 and is sorted for each denomination in the second passage portion 25.

Additionally, as shown in FIG. 2(*c*), when a deformed coin C2 having deformation passes under the detecting elements 64 of the coin-thickness detecting bodies 60, the detecting elements 64 are pushed up greatly in excess of the thickness of the deformed coin C2 against the biasing force of the elastic members 67. The detecting elements 64 move upward by a distance corresponding to the degree of deformation of the deformed coin C2. Thus, the coin-thickness detecting bodies 60 rock around the support shafts 63 by the upward movement of the detecting elements 64, and the light shielding portions 65 move downward. Due to the downward movement of the shielding portions 65, the amount of the light, which is to be received by the light receiving portion 71 from the light source 70 but is shielded by the light shielding portions 65, becomes smaller than that in the case of the non-deformed coin C1, and the light shielding amount is detected by the light detecting portion 69. At this time, since the pair of coin-thickness detecting bodies 60 are independently movably arranged in the passage width direction, downward movement of the shielding portion 65 of one of the coin-thickness detecting bodies 60 is sometimes greater than that of the shielding portion 65 of the other coin-thickness detecting body 60 in accordance with the deformation location of the deformed coin C2. However, the light shielding amount detected by the light detecting portion 69 is decided by the shielding portion 65 having the greater downward movement.

The deformed coin C2, which has passed under the detecting elements 64 of the coin-thickness detecting bodies 60, is transported to the coin denomination determining unit 43 at the downstream side, and a denomination of the deformed coin C2 is determined by the coin denomination determining unit 43.

The control portion 81 reads the reference light shielding amount pre-stored in the reference light shielding amount storing unit 82 regarding the denomination determined by the coin denomination determining means 43, compares the light shielding amount detected by the light detecting portion 69 with the reference light shielding amount, and judges whether the detected light shielding amount is out of a predetermined range with respect to the reference light shielding amount.

Here, since the deformed coin C2 is transported, the detected light shielding amount is out of the predetermined range with respect to the reference light shielding amount, and the coin C2 is detected as a deformed coin. Therefore, the deformed coin C2 is diverted by the coin diverting portion 44, accommodated in the return box 17 and can be returned.

As described above, according to the deformed-coin detector 41, the coin transported along the coin transporting face 26 comes into contact with the detecting elements 64 of the coin-thickness detecting bodies 60, and thus, the detecting elements 64 move by the distance corresponding to the dimension of the coin in its thickness direction and simultaneously, the light shielding portions 65 of the coin-thickness detecting bodies 60 move, the light shielding amount detected by the light detecting portion 69 varies in accordance with the movement of the light shielding portions 65, the light shielding amount detected by the light detecting portion 69 is compared with the reference light shielding amount pre-stored in the reference light shielding amount storing unit 82 regarding the denomination, which is determined by a coin denomination determining unit 43, of the coin transported along the coin transporting face 26, and the coin transported along the coin transporting face 26 can be judged to be a deformed coin in the case where the detected light shielding amount is out of the predetermined range with respect to the reference light shielding amount. Thus, the deformed coin can be accurately detected without being affected by a variation in the transporting speed of the coin.

In particular, since the thicknesses of the coins of U.S. denominations are within a wide range, from 1.30 mm to 2.05 mm, the deformed coin can be accurately detected by comparing the light shielding amount detected in accordance with the thickness of the coin with the reference light shielding amount for each denomination.

The rotation of the coin-thickness detecting bodies 60 around support shafts 63 allows the light shielding portions 65 to be moved by the distance corresponding to the dimension of the coin in its thickness direction, and thus, the precise light shielding amount can be detected by the light detecting portion 69.

Since the detecting elements 64 of the coin-thickness detecting bodies 60 each is cylindrically provided corresponding to the transporting direction of the coin transporting face 26 and provided rotatably in the circumferential direction, they can be smoothly brought into contact with the coin and wear of the detecting elements 64 can be reduced.

Since the plurality of coin-thickness detecting bodies 60 are independently movably arranged at a plurality of positions in the passage width direction, the light shielding amount to be detected by the light detecting portion 69 is decided by any one of the light shielding portions 65 of the coin-thickness detecting bodies 60, the size and deformation location or the like of the coin can be handled, and thus, the deformed coin can be reliably detected.

Moreover, the coin-thickness detecting bodies 60 are not limited in structure to only rock around the support shafts 63, and may be vertically slidably moved.

Additionally, as the detecting element 64, not only the roller bearing rotatable corresponding to the coin transporting direction but also a member having a small friction coefficient against a coin are applicable.

Additionally, as the elastic member 67, not only the extension spring but also another member, such as a compression spring or leaf spring, capable of giving elasticity are applicable.

A deformed-coin detector of the present invention can be used for not only an automatic change dispenser but also, for example, another coin processing machine such as a coin depositing machine or coin depositing and dispensing machine.

The invention claimed is:

1. A deformed-coin detector comprising:

a coin-thickness detecting body having a detecting element which is arranged facing a coin transporting face, comes into contact with a coin transported along the coin transporting face when the coin passes therethrough, and moves by a distance corresponding to the dimension of the coin in its thickness direction, and a light shielding portion moving in conjunction with movement of the detecting element;

an elastic member for elastically biasing the detecting element of the coin-thickness detecting body to the coin transporting face side;

a light detecting portion which has a light source and a light receiving portion, which are arranged across the light shielding portion of the coin-thickness detecting body from each other, and detects a light shielding amount varied in accordance with movement of the light shielding portion of the coin-thickness detecting body;

a coin denomination determining unit for determining a denomination of the coin transported along the coin transporting face;

a reference light shielding amount storing unit for, for each denomination, pre-storing a reference light shielding amount that is detected by the light detecting portion when a non-deformed coin passes through the position of the detecting element of the coin-thickness detecting body; and a control portion for, when the coin is transported along the coin transporting face, comparing the light shielding amount detected by the light detecting portion with the reference light shielding amount pre-stored in the reference light shielding amount storing unit regarding the denomination determined by the coin denomination determining unit, and judging that the coin transported along the coin transporting face is a deformed coin in the case where the detected light shielding amount is out of a predetermined range with respect to the reference light shielding amount.

2. A deformed-coin detector according to claim 1, wherein the detecting element is provided at one end of the coin-thickness detecting body, the light shielding portion is provided at the other end thereof, and the detecting element and the light shielding portion are provided rotatably around a support shaft so as to rock.

3. A deformed-coin detector according to claim 1, wherein the detecting element of the coin-thickness detecting body is cylindrically provided corresponding to a transporting direction of the coin transporting face, and provided rotatably in its circumferential direction.

4. A deformed-coin detector according to claim 1, wherein a plurality of the coin-thickness detecting bodies are provided and independently movably arranged at a plurality of positions of the coin transporting face in its width direction.

* * * * *